US009339119B2

(12) United States Patent
Mullins

(10) Patent No.: US 9,339,119 B2
(45) **Date of Patent: *May 17, 2016**

(54) BABY SUPPORT

(71) Applicant: Hayley Mullins, Toronto (CA)

(72) Inventor: Hayley Mullins, Toronto (CA)

(73) Assignee: Hayley Mullins, Toronto, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/174,990

(22) Filed: Feb. 7, 2014

(65) Prior Publication Data

US 2014/0224846 A1 Aug. 14, 2014

Related U.S. Application Data

(63) Continuation of application No. 14/120,918, filed on Dec. 2, 2013.

(60) Provisional application No. 61/763,873, filed on Feb. 12, 2013.

(51) Int. Cl.
*A47D 13/02* (2006.01)

(52) U.S. Cl.
CPC ..... *A47D 13/025* (2013.01); *A47D 13/02* (2013.01)

(58) Field of Classification Search
CPC ..... A47D 13/02; A47D 13/025
USPC ..... 224/158, 159
See application file for complete search history.

(56) References Cited

U.S. PATENT DOCUMENTS

| | | | | | |
|---|---|---|---|---|---|
| 3,256,882 | A | * | 6/1966 | Huber | 602/60 |
| 3,442,270 | A | * | 5/1969 | Steinman | 602/79 |
| 3,623,488 | A | * | 11/1971 | Nakayama | 450/45 |
| 4,601,075 | A | * | 7/1986 | Smith | 5/628 |
| D306,655 | S | * | 3/1990 | Schlegel Liebert | D3/214 |
| D378,632 | S | * | 4/1997 | Popp | D3/213 |
| 5,857,598 | A | | 1/1999 | Dunne | |
| 5,950,887 | A | * | 9/1999 | Powell | 224/158 |
| 6,112,960 | A | * | 9/2000 | Seering et al. | 224/158 |
| 6,325,259 | B1 | | 12/2001 | Tharalson et al. | |
| 6,378,746 | B1 | * | 4/2002 | Miller | 224/258 |

(Continued)

FOREIGN PATENT DOCUMENTS

| | | |
|---|---|---|
| EP | 2366312 A1 | 9/2011 |
| GB | 2286329 A | 8/1995 |

(Continued)

OTHER PUBLICATIONS

Korean Intellectual Patent Office, Notice of Preliminary Rejection dated Oct. 29, 2015, issued on Korean Patent Application No. 10-2015-7024233.

(Continued)

*Primary Examiner* — Justin Larson

(74) *Attorney, Agent, or Firm* — Norton Rose Fulbright Canada LLP; Maya Medeiros

(57) ABSTRACT

A baby support for supporting a baby positioned on a front torso of a supporting person. The baby support includes an elongated soft body that extends across a back torso of the supporting person and the baby. The baby support also includes fastening ends that overlap and secure to support the baby on the front torso of the supporting adult. The baby support may be configured to stretch to generate an elastic force to pull the back torso of the baby towards the back torso of the supporting person.

19 Claims, 14 Drawing Sheets

(56) References Cited

U.S. PATENT DOCUMENTS

| | | | | |
|---|---|---|---|---|
| 7,181,775 | B2 * | 2/2007 | Carney | 2/311 |
| 7,444,695 | B2 * | 11/2008 | Gonzalez | 5/494 |
| 8,276,216 | B2 * | 10/2012 | Carney | 2/311 |
| 8,403,189 | B2 * | 3/2013 | Nyberg et al. | 224/160 |
| 2003/0176825 | A1 * | 9/2003 | Yavnai | 602/13 |
| 2004/0182895 | A1 * | 9/2004 | Paul | 224/159 |
| 2007/0118062 | A1 * | 5/2007 | Fleck | 602/75 |
| 2008/0149674 | A1 * | 6/2008 | Hiniduma-Lokuge | 224/159 |
| 2010/0235965 | A1 * | 9/2010 | Frandsen et al. | 2/237 |
| 2011/0004970 | A1 * | 1/2011 | Okamoto | 2/69 |
| 2011/0226822 | A1 * | 9/2011 | Higuchi | 224/159 |
| 2012/0187173 | A1 * | 7/2012 | Sonnenberg | 224/581 |
| 2013/0291279 | A1 * | 11/2013 | Jensen et al. | 2/69 |
| 2014/0076943 | A1 * | 3/2014 | Ng | 224/160 |
| 2014/0224846 | A1 * | 8/2014 | Mullins | 224/159 |
| 2014/0231472 | A1 * | 8/2014 | Cha | 224/160 |
| 2014/0283277 | A1 * | 9/2014 | Wilhelm | 2/69.5 |

FOREIGN PATENT DOCUMENTS

| | | | |
|---|---|---|---|
| KR | 20-0289461 | Y1 | 9/2002 |
| KR | 20-0355799 | Y1 | 7/2004 |

OTHER PUBLICATIONS

Colombian Patent Office, Technical Examination dated Sep. 29, 2015, issued on Colombian Patent Application No. 15-215218.

* cited by examiner

FIG. 7A
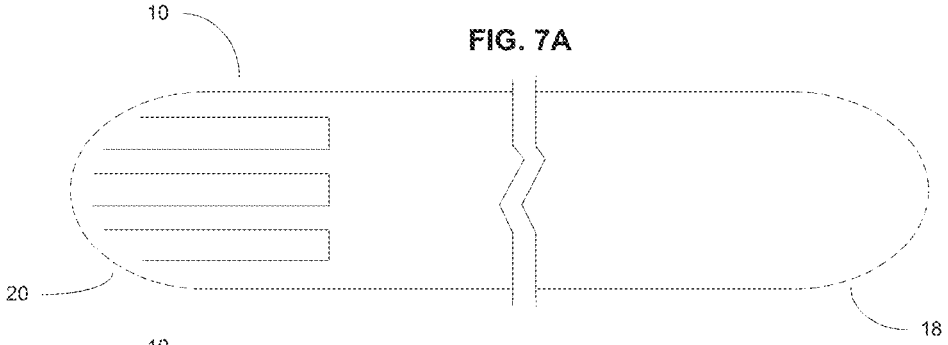
FIG. 8A
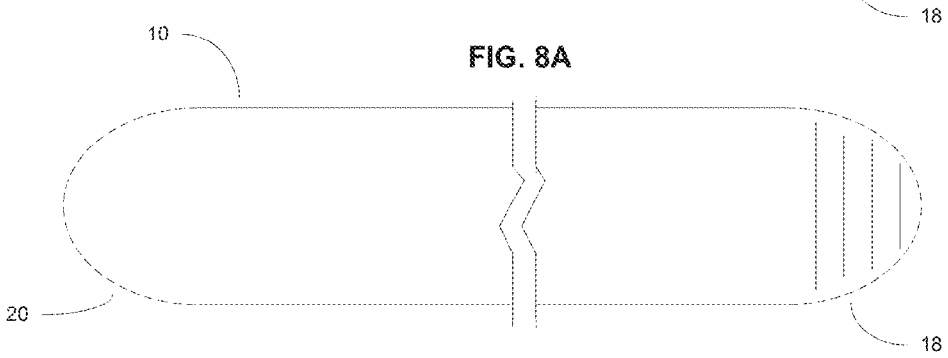
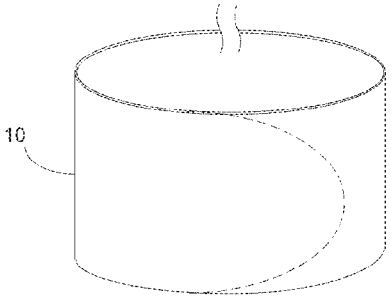
FIG. 8AA
FIG. 9A
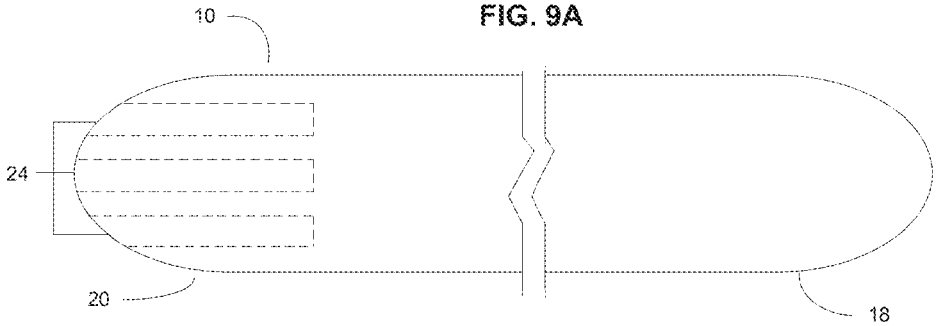
FIG. 10A
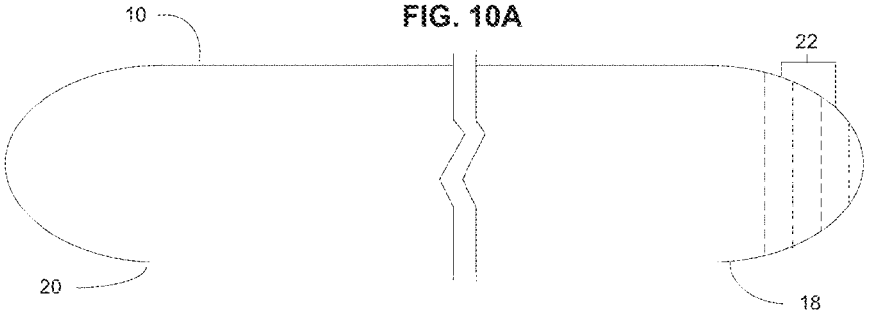

BABY SUPPORT

FIELD

The embodiments described herein relate to a baby support, and in particular, to a baby support for use by a person to support a baby while it rests.

INTRODUCTION

A baby may enjoy sleeping or resting on a person's chest or front torso as they may be calmed by the heartbeat, body heat, contact, and comfort of the person. Further, there may be developmental and health benefits from calming baby, such as increase lactation, temperature regulation, and so on. However, if the person is not paying close attention, such as if they also fall asleep or otherwise distracted, the baby may roll or fall off the torso of the supporting person which may cause harm to the baby. Accordingly, there exists a need for a baby support for use when a baby rests or sleeps on a person's chest or front torso, or at least an alternative.

SUMMARY

In a first aspect, embodiments described herein may provide a baby support for use in supporting a baby positioned on a front torso of a supporting person. The support may have an elongated soft body, wherein in use the elongated soft body extends around a portion of a back torso of the supporting person and around a portion of a back torso of the baby. The support may have an adjustable fastening mechanism integrally connected to the elongated soft body to secure the baby on a front torso of the supporting adult. A portion of the support (e.g. elongated soft body, sides, back portion, front portion) may be configured to stretch to generate an elastic force to pull the back torso of the baby towards the back torso of the supporting person. The elastic force and the adjustable fastening mechanism may work together to provide a snug, secure and comfortable support for the baby.

In accordance with some embodiments, a portion or the entire height of at least a portion of the support (e.g. elongated soft body) is configured to stretch in a lengthwise direction to distribute the elastic force along the height or portion thereof of the at least a portion of the elongated soft body.

In accordance with some embodiments, the support or the elongated soft body is configured to stretch in four directions. This may contour the baby to provide a secure and snug support when the supporting person is sitting, laying, or configured in another position.

In accordance with some embodiments, the support or the elongated soft body is configured to stretch in a lengthwise direction to pull the back torso of the baby towards the back torso of the supporting person.

In accordance with some embodiments, the support or the elongated soft body is configured to stretch in a lengthwise and a crosswise direction.

In accordance with some embodiments, the support or the adjustable fastening mechanism is affixed to first and second ends of the elongated soft body. The support may wrap around the torso of the support adult and baby and secure by way of the adjustable fastening mechanism.

In accordance with some embodiments, in use the baby support positions the baby on the front torso of the supporting person such that the skin of the baby is in direct contact with the skin of the supporting person.

In accordance with some embodiments, the adjustable fastening mechanism comprises a first fastener affixed to a first end of the elongated soft body and a second fastener affixed to a second end of the elongated soft body, wherein the a first fastener adjustably mates with the second fastener.

In accordance with some embodiments, the adjustable fastener mechanism may be configured to adjustably fasten in a plurality of positions such that each position provides a different perimeter for the baby sleep support when the fastener mechanism secures the baby support.

In accordance with some embodiments, the adjustable fastener mechanism may be configured on the ends of the baby support.

In accordance with some embodiments, the support has a front side and a rear side, where adjustable fastener mechanism includes a second fastener mechanism on the front side and a first fastener mechanism on the rear side.

In another aspect, embodiments described herein provide a baby support for supporting a baby positioned on a front torso of a supporting person. The support may have an elongated soft body with a first and a second end, wherein in use the elongated soft body extends across a back torso of the supporting person, the first end extending under an arm and across a side torso of the supporting person, and the second end extending under the other arm and across the other side torso of the supporting person. A first fastening end may integral connect to the first end of the elongated soft body, the first fastening end having a first fastener mechanism. In use the first fastening end extends across a back torso of the baby. A second fastening end may be integrally connected to the second end of the elongated soft body, the second fastening end having a second fastener mechanism configured to mate with the first fastener mechanism of the first fastening end. In use the second fastening end may overlap the first fastening end to affix the second fastener mechanism to the first fastener mechanism to support the baby on the front torso of the supporting adult. Wherein at least a portion of the elongated soft body is configured to stretch to generate an elastic force to pull the back torso of the baby towards the back torso of the supporting person.

In accordance with some embodiments, the support or the elongated soft body has a rectangular shape. The first fastening end may have a semi elliptical shape, and the second fastening end may have a semi elliptical shape. The first end of the elongated soft body is proportionally sized and integrally connected to a major axis of the first fastening end and the second end of the elongated soft body is proportionally sized and integrally connected to a major axis of the second fastening end.

In accordance with some embodiments, the second fastener mechanism may be configured to adjustably mate with the first fastener mechanism in a plurality of positions such that each position provides a different perimeter for the baby sleep support when the second fastening end overlaps the first fastening end to secure the baby sleep support.

In accordance with some embodiments, the first and second fastening ends are tapered.

In accordance with some embodiments, first and second fastener mechanisms comprise fabric hook and loop fasteners.

In accordance with some embodiments, the second fastener mechanism comprises one or more strips of fabric loop fasteners parallel to a longitudinal axis of the baby sleep support and the first fastener mechanism comprises one or more strips of fabric hook fasteners perpendicular to the longitudinal axis of the baby sleep support.

In accordance with some embodiments, the second fastener mechanism comprises one or more strips of fabric hook fasteners parallel to a longitudinal axis of the baby sleep support and the first fastener mechanism comprises one or more strips of fabric loop fasteners perpendicular to the longitudinal axis of the baby sleep support.

In accordance with some embodiments, the support or the elongated soft body comprises stretch fabric. The stretch fabric may be four way stretch fabric.

In accordance with some embodiments, the support comprises a first and second pieces of stretch fabric sewn together at the perimeters, wherein the elongated soft body has a front and back side, wherein the first fastening end has a front and back side, and wherein the second fastening end has a front and back side, wherein the first piece of stretch fabric provides the front sides and the second piece of stretch fabric provides the back sides.

In accordance with some embodiments, the support has a front side and a rear side, wherein the second fastener mechanism is on the front side and the first adjustable fastener mechanism is on the rear side.

In accordance with some embodiments, the support or the elongated soft body comprises a cushion for supporting the back torso of the supporting person.

In accordance with some embodiments, the first and second adjustable fastener mechanisms comprise buttons and button holes.

In accordance with some embodiments, the first and second adjustable fastener mechanisms comprise snaps. Other examples include ties, buckles, toggle straps, clips, and so on.

In accordance with some embodiments, the first and second adjustable fastener mechanisms comprise hooks and eyes.

In accordance with some embodiments, the first and second adjustable fastener mechanisms comprise elastic loops and tabs.

In another aspect, embodiments described herein may provide a baby support for supporting a baby positioned on a front torso of a supporting person, the support comprising: an elongated soft body with a first and a second end; a first fastening end integrally connected to the first end of the elongated soft body, the first fastening end having a first fastener mechanism; and a second fastening end integrally connected to the second end of the elongated soft body, the second fastening end having a second fastener mechanism configured to adjustably mate with the first adjustable fastener mechanism of the first fastening end; wherein in use the baby sleep support extends across a back torso of the supporting person, under each arm of the supporting person, across each side torso of the supporting person, and across a back torso of the baby, wherein the baby sleep support overlaps to affix the second fastener mechanism to the first fastener mechanism to support the baby on the front torso of the supporting adult, wherein at least a portion of the elongated soft body is configured to stretch to generate an elastic force to pull the back torso of the baby towards the back torso of the supporting person.

In accordance with some embodiments, the baby support has a front side and a rear side, wherein the second fastener mechanism is on the front side and the first adjustable mechanism is on the rear side.

DRAWINGS

The drawings included herewith are for illustrating various examples of articles, methods, and apparatuses of the present specification and are not intended to limit the scope of what is taught in any way. In the drawings:

FIGS. 7A and 7B are front views of a baby sleep support according to some embodiments;

FIGS. 8A and 8B are rear views of a baby support according to some embodiments;

Figure 8B:
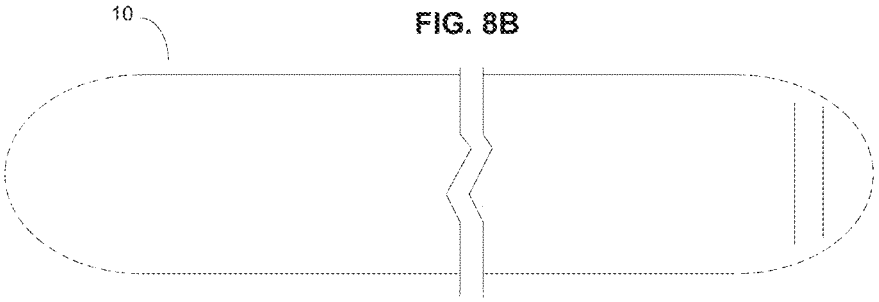
Figure 9B:
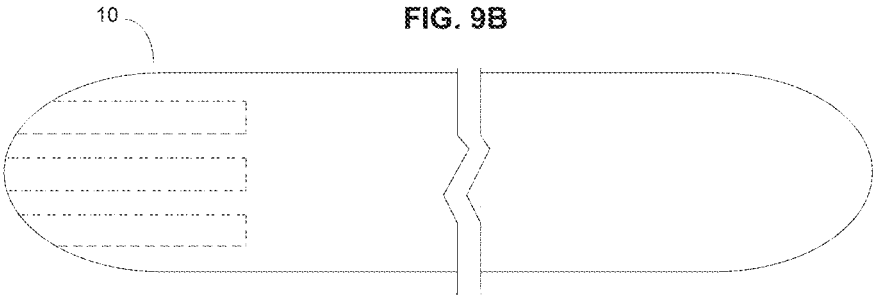
Figure 10B:
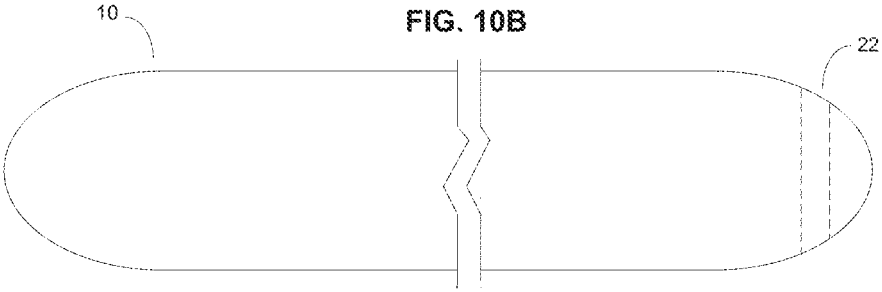
Figure 11A:
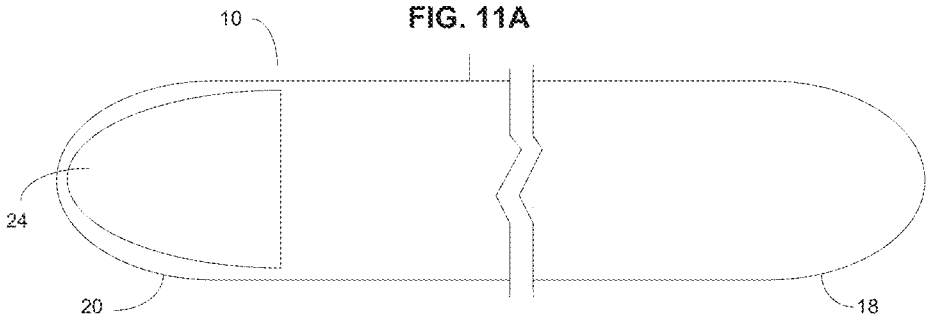
Figure 12A:
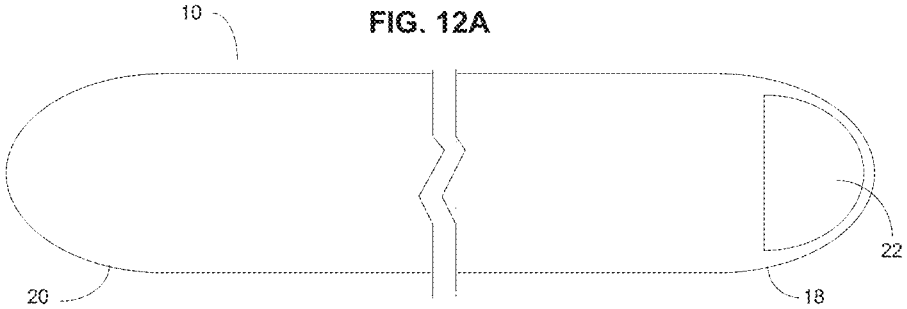
Figure 13A:
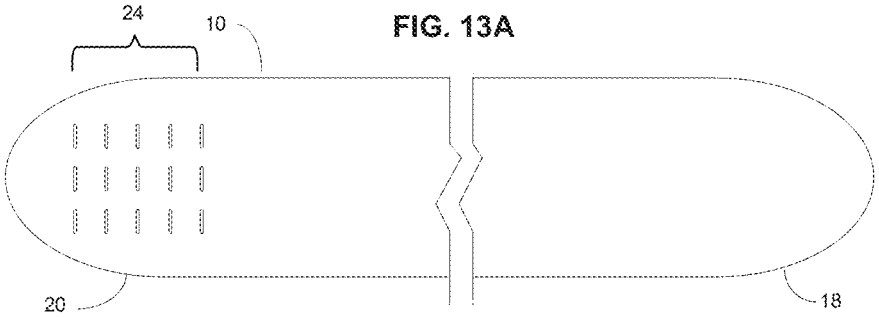
Figure 14A:
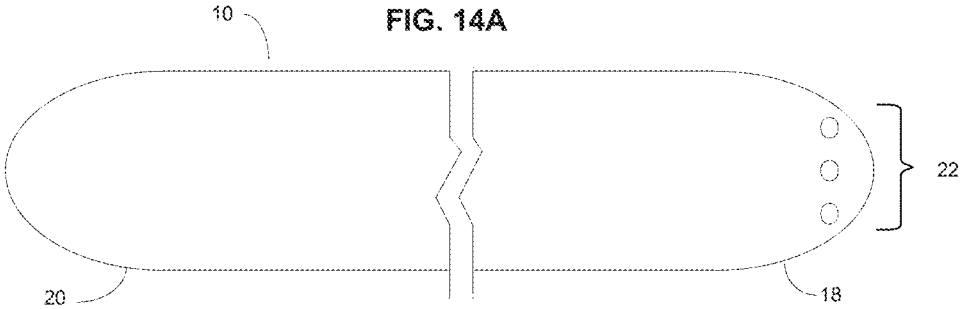
Figure 11B:
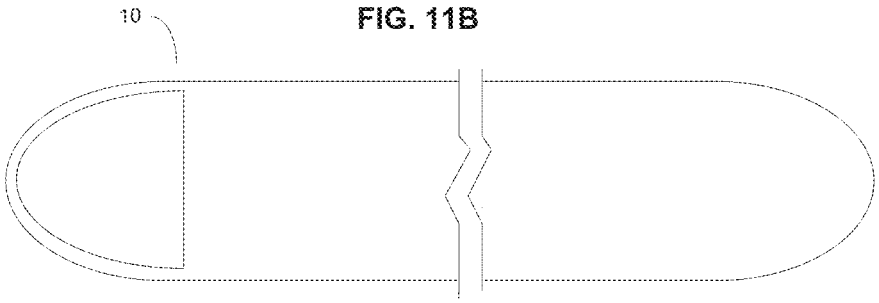
Figure 12B:
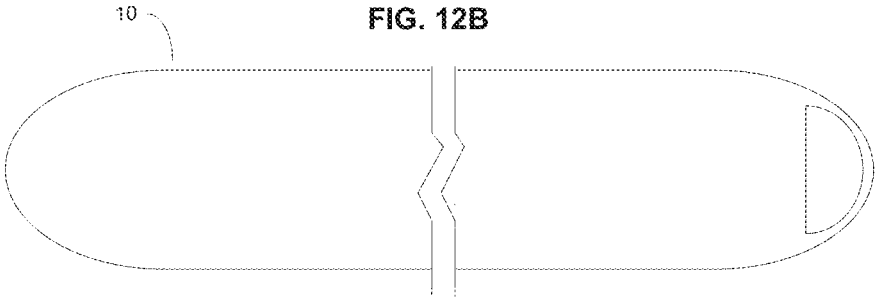
Figure 13B:
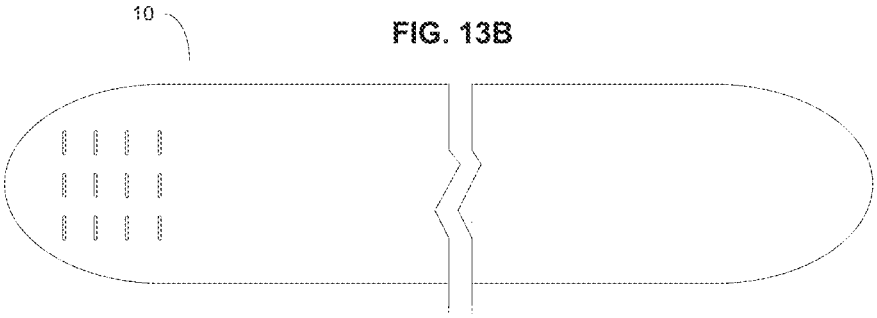
Figure 14B:
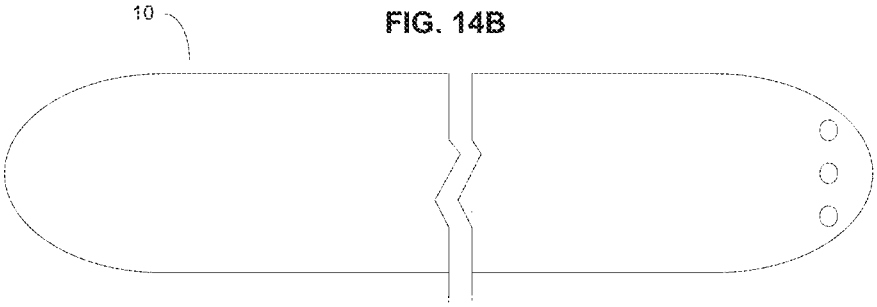
Figure 15A:
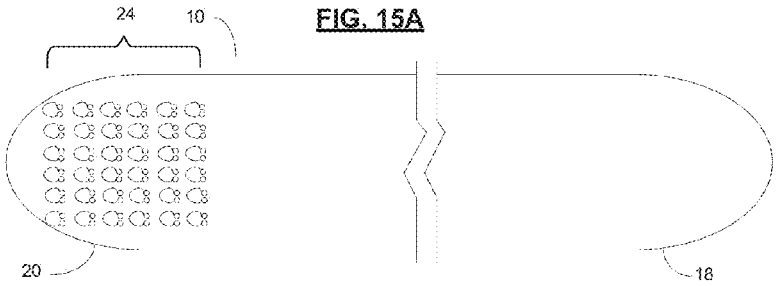
Figure 16A:
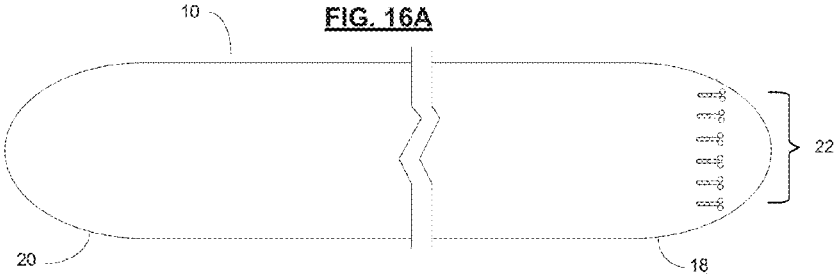
Figure 17A:
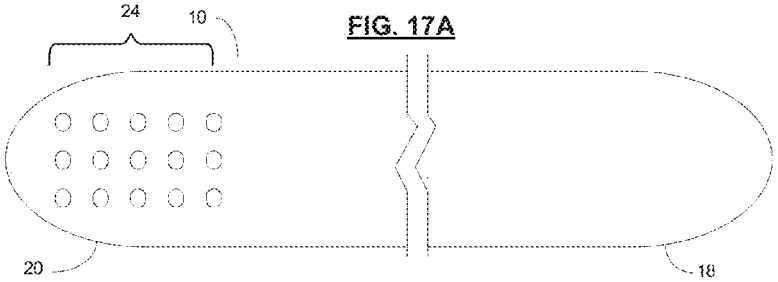
Figure 18A:
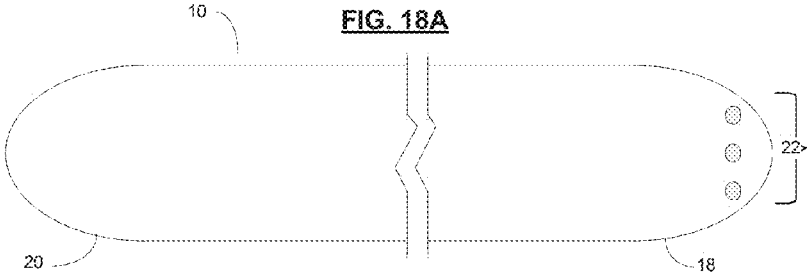
Figure 15B:
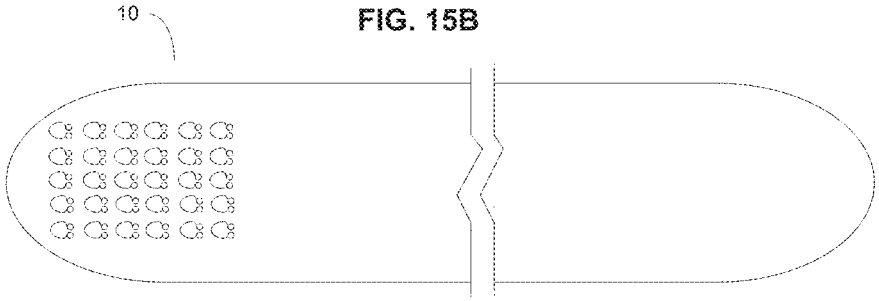
Figure 16B:
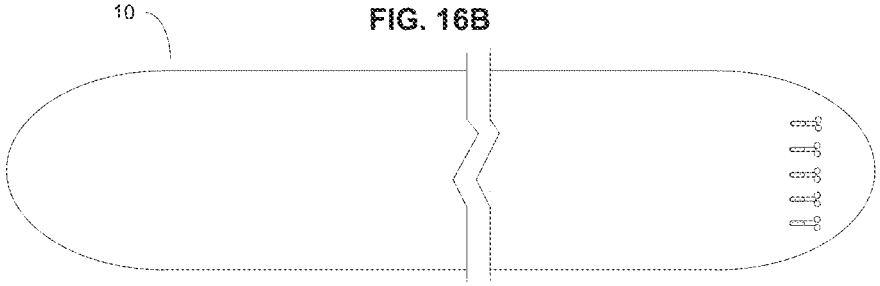
Figure 17B:
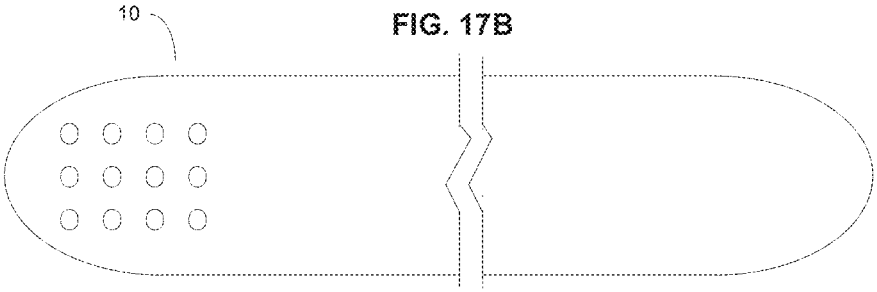
Figure 18B:
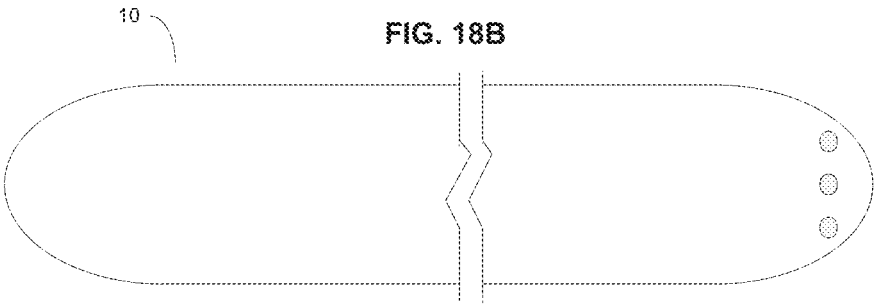
Figure 19A:
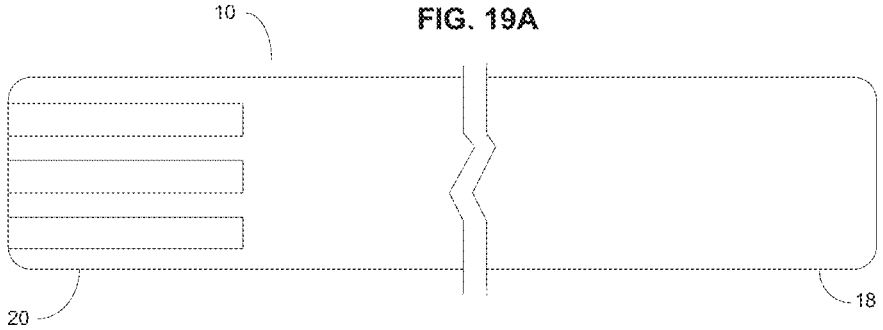
Figure 20A:
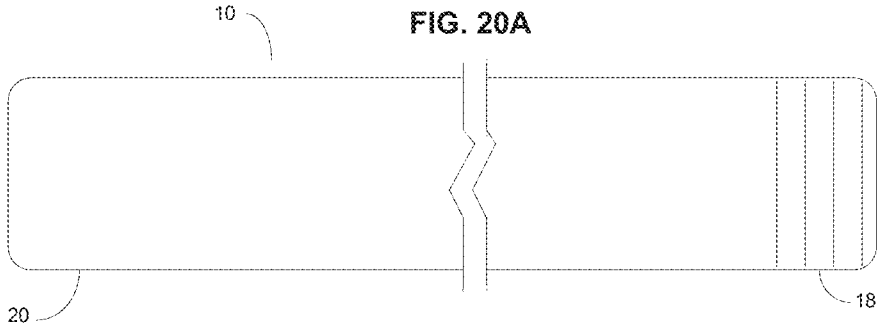
Figure 21A:
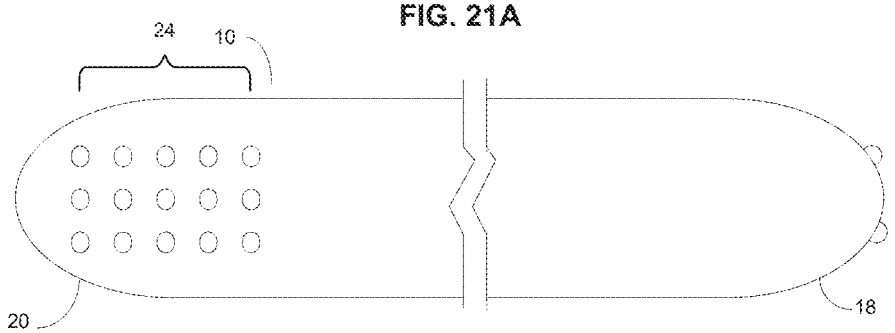
Figure 22A:
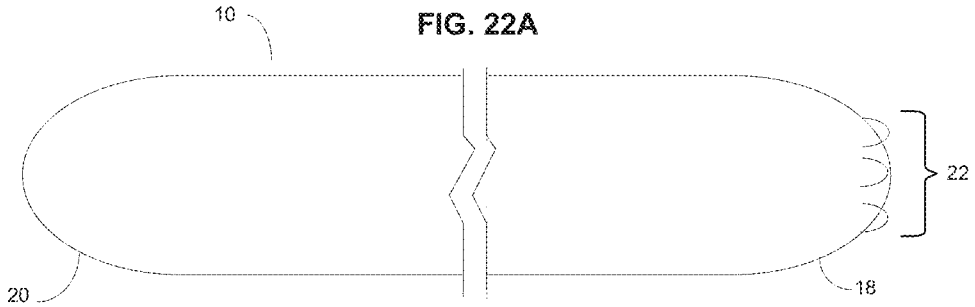
Figure 19B:
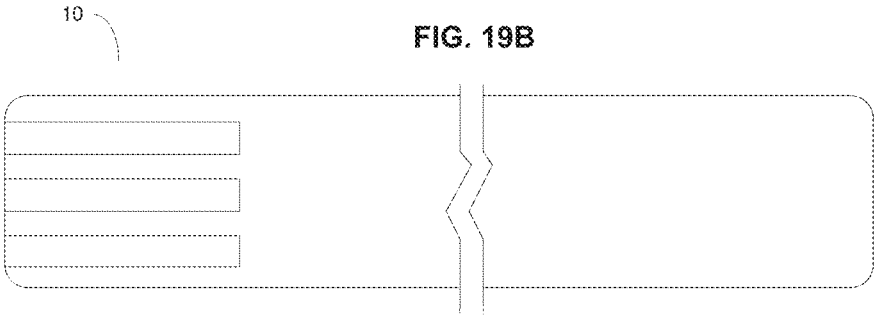
Figure 20B:
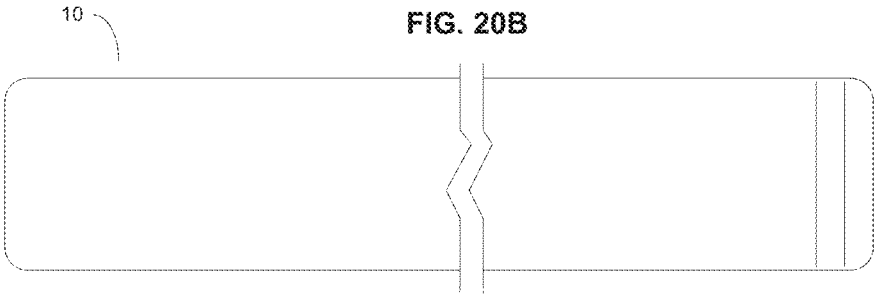
Figure 21B:
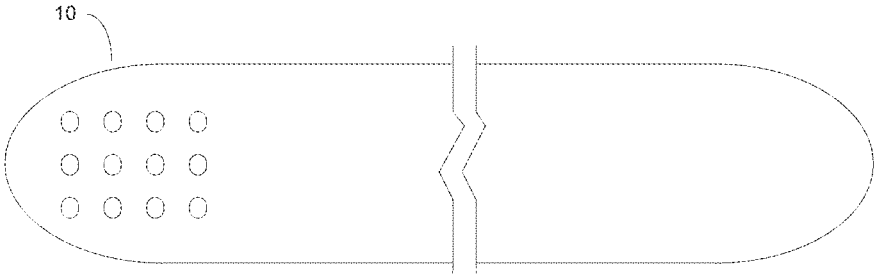
Figure 22B:
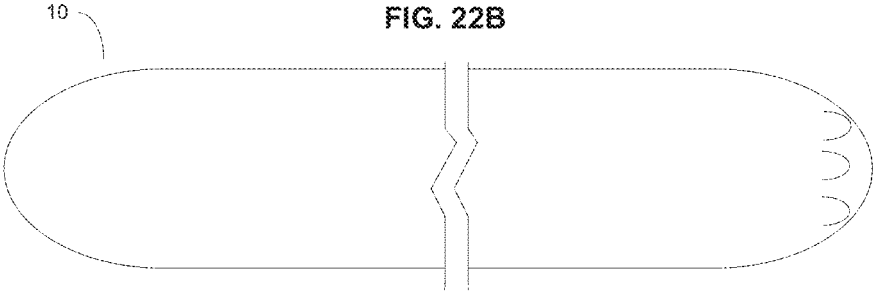
Figure 23:
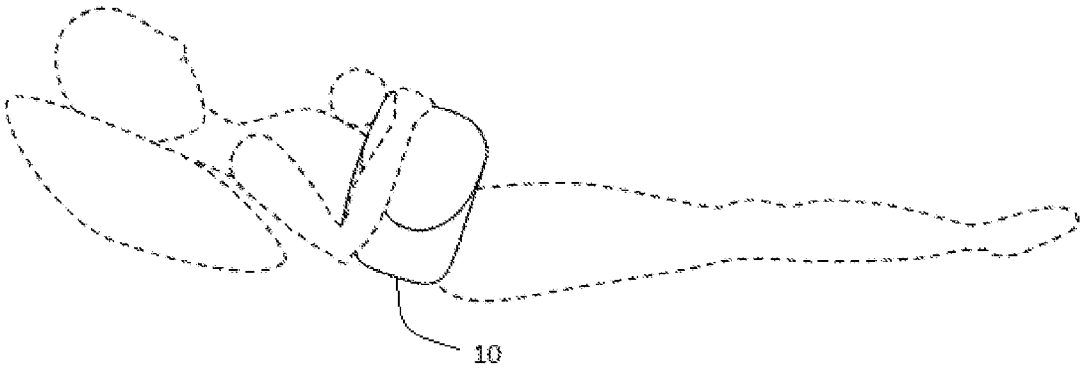
Figure 24:
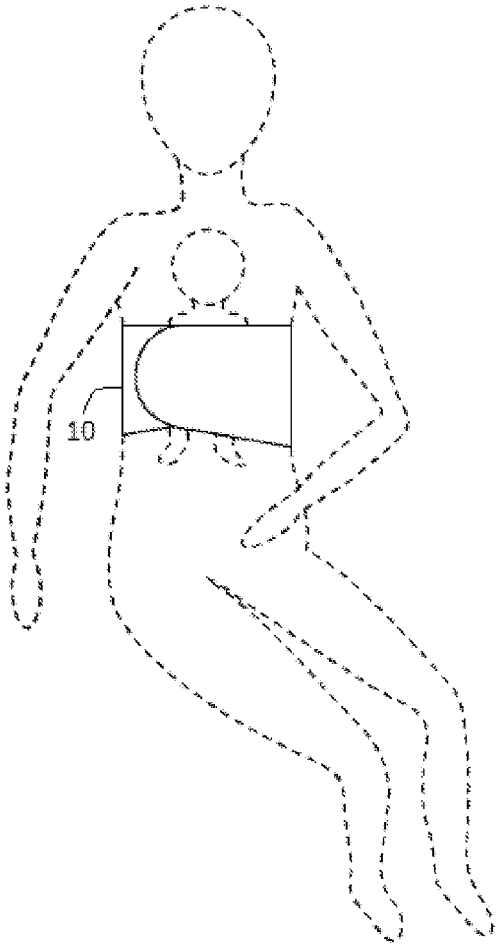
Figure 25:
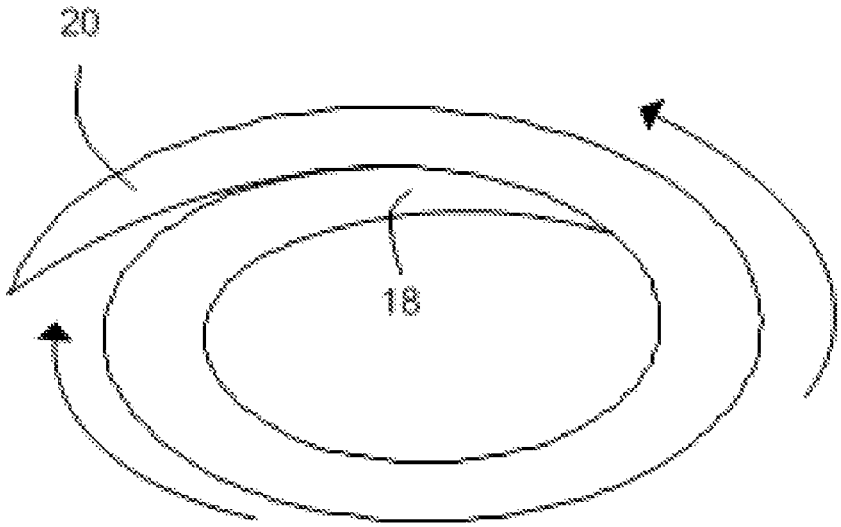
Figure 26:
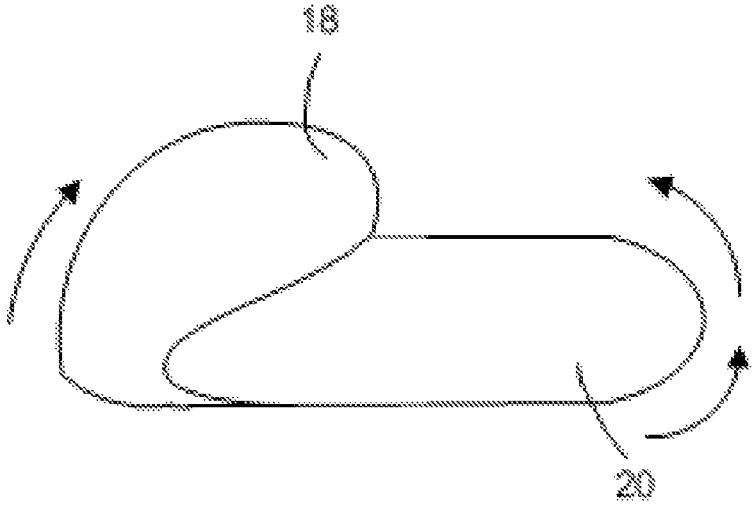
Figure 27:
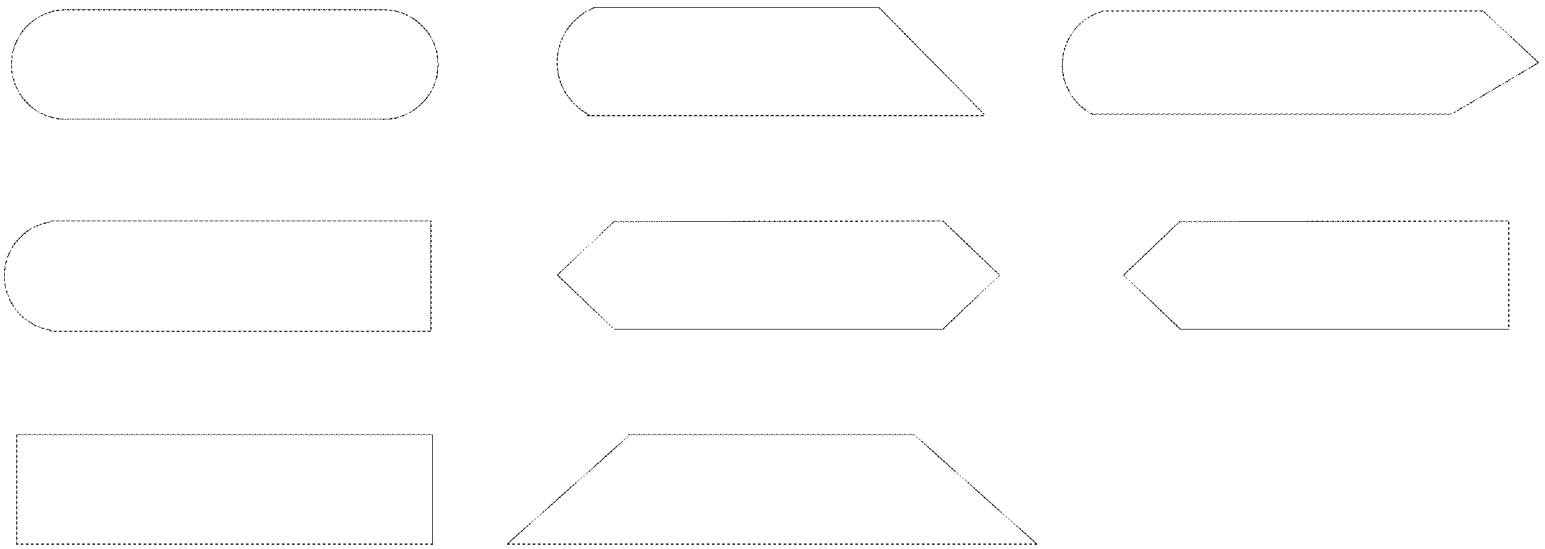
Figure 28:
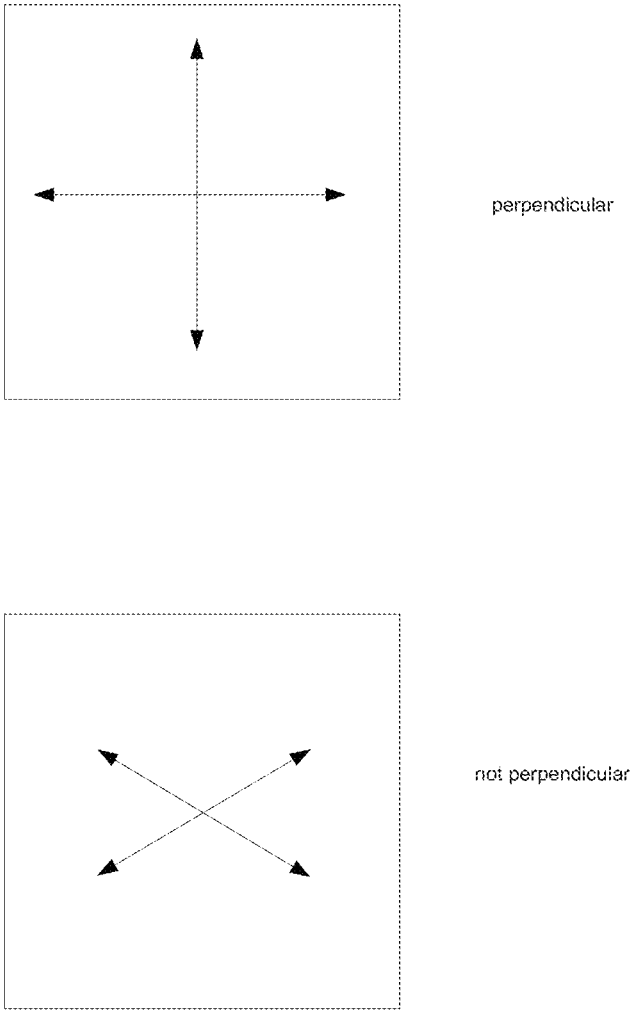

FIG. 8AA is another perspective view of a baby support when the ends of the baby sleep support are secured according to some embodiments;

FIGS. 9A and 9B are front views of a baby support according to some embodiments;

FIGS. 10A and 10B are rear views of a baby support according to some embodiments;

FIGS. 11A and 11B are front views of a baby support with a section of fabric hook and loop fastener according to some embodiments;

FIGS. 12A and 12B are rear views of a the baby support with a section of fabric hook and loop fastener according to some embodiments;

FIGS. 13A and 13B are front views of a baby support with columns of button holes according to some embodiments;

FIGS. 14A and 14B are rear views of a baby support with a column of buttons according to some embodiments;

FIGS. 15A and 15B are front views of a baby support with columns of eyes according to some embodiments;

FIGS. 16A and 16B are rear views of a baby support with a column of hooks according to some embodiments;

FIGS. 17A and 17B are front views of a baby support with columns of half snaps according to some embodiments;

FIGS. 18A and 18B are rear views of a baby support with a column of mating half snaps according to some embodiments;

FIGS. 19A and 19B are front views of a baby support according to some embodiments;

FIGS. 20A and 20B are rear views of a baby support according to some embodiments;

FIGS. 21A and 21B are front views of a baby support with columns of tabs according to some embodiments;

FIGS. 22A and 22B are rear views of a baby support with a column of hoops according to some embodiments;

FIG. 23 is a view of an environment for the baby support to illustrate the use of the baby sleep support according to some embodiments;

FIG. 24 is a view of an environment for the baby support to illustrate the use of the baby sleep support according to some embodiments;

FIG. 25 is a top view of a baby support when fastening ends overlap to secure the baby sleep support according to some embodiments;

FIG. 26 is a top view of a baby support in progress of securing the fastening ends according to some embodiments;

FIG. 27 is a view of variant shape configurations for a baby support according to some embodiments; and FIG. 28 illustrates arrows showing four-way stretch fabric for the baby support according to some embodiments.

DESCRIPTION OF VARIOUS EMBODIMENTS

Embodiments described herein may provide a baby support to secure a baby or infant positioned on the front torso of a supporting person. The baby support may be configured to provide support for baby in resting position. The baby support may be configured as a wearable fabric support for retaining infant in resting position. The baby support may provide hands free skin-to-sin support system for retaining infant in resting position.

A baby or infant may enjoy sleeping on a person's chest or front torso as they may be calmed by the heartbeat, body heat, contact, and comfort of the person. The baby support in accordance with embodiments described herein may snuggly and supportively secure the baby to the person so that if the person is not close paying attention, such as if they fall asleep, are distracted by use of a tablet computer, and so on, the baby may be prevented from rolling or falling off the chest which may cause harm to the baby. The baby support may help prevent falls and accidents and enable the supporting person to relax knowing the baby is secure on their front torso. The baby support may enable the supporting person to do other various activities, such as reading a book or using a computer or smartphone, while the baby remains supported hands-free. The baby support may be referred to herein as a baby sleep support.

The baby sleep support 10 may enable direct contact between the baby and the supporting person by not having a layer of fabric between the baby and the supporting person. This direct contact may facilitate skin to skin bonding and breast feeding.

The baby support may be configured to stretch to generate an elastic force to pull the back torso of the baby towards the back torso of the supporting person. The elastic force or stretch may be in the lengthwise direction, and crosswise direction, for example. The force acts to snugly and securely support the baby on the supporting person. The elastic force may be distributed long the entire height (or a substantial part of the height) of the baby support.

In accordance with embodiments described herein, the baby support may be configured to generate an elastic force and to adjustably fasten in a variety of positions and sizes. The use of elastic force and an adjustable fastening mechanism may provide a synergistic result of a secure and snug fit for the baby and the supporting person.

Referring now to FIGS. 1A, 1B, 2A and 2B there is shown front and rear views of a baby sleep support 10 for supporting a baby positioned on a front torso of a supporting person. The broken lines illustrated in FIG. 1A (and the other figures) indicate an indeterminate length of the baby sleep support 10 as it may be manufactured having various lengths to accommodate different size people and babies. The baby sleep support 10 may include an elongated soft body 12 with a first end 14 and second end 16. The height of the baby sleep support 10 may be proportional to the average length of a person's torso, the average length of a baby and so on. The baby sleep support 10 may be made of a soft fabric material and the elongated soft body 12 may be longitudinally oriented, as shown. In use, the elongated soft body 12 extends across or around a back torso of a supporting person, with the first end 14 extending under a shoulder and across a side torso of the supporting person, and the second end 16 extending under the other shoulder and across the other side torso of the supporting person. That is, the elongated soft body 12 wraps around the back torso and under the arms or armpits of the supporting person.

To illustrate the use of the baby sleep support 10, reference is now made to FIGS. 23 and 24, which show views of environments for the baby sleep support according to some embodiments. The baby sleep support 10 wraps or secures around the torso and under the arms of the supporting person and across the back of the baby to support the baby on the chest or front torso of the supporting person. FIG. 23 illustrates a supporting person laying down on a bed or couch, for example, and FIG. 24 illustrates a supporting person sitting down on a chair or couch, for example.

The baby sleep support 10 may be strong, secure and supportive for the supporting person and the baby so that the supporting person can rest and relax without worrying that the baby will roll or fall off its chest or front torso. For example, a newborn may be placed on the chest of the mother and fall asleep, and even though the mother may be exhausted after childbirth the mother may be unable to relax and worry that the newborn will roll off and fall to the floor if the mother herself sleeps. Using the baby sleep support 10 the mother can rest knowing that the baby is safely secured to her front torso.

The baby sleep support 10 may include elastic or stretch material to generate a force pulling the baby towards the person. This may enable the baby sleep support 10 to securely support the baby to the person. The entire baby sleep support 10 may be made of stretch fabric, or a portion of the baby sleep support 10 may be made of stretch fabric to generate the elastic force to pull the baby towards to the person.

The baby sleep support 10 may be configured to distribute an elastic force across the entire (or a substantial part) of the height of the baby sleep support 10. The distribution across the height of the baby sleep support 10 may in turn distribute the pulling force along the back of the torso of the person and baby so that the elastic force does not pull the baby or the person in a concentrated area or small section.

Figure 3A:
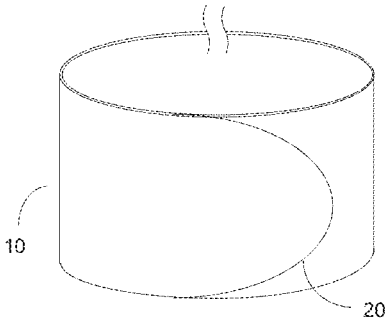
FIGS. 3A and 3B are perspective views of a baby support when the ends of the baby support are secured according to some embodiments.
Figure 3B:
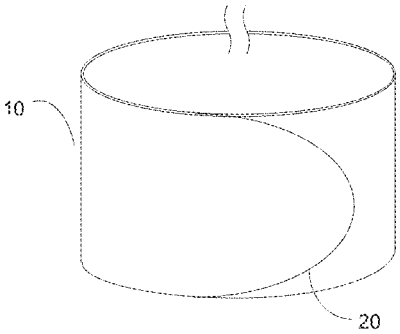

The elastic force may be perpendicular to the height of the baby sleep support 10 to pull the baby towards the support person when the ends are secured (see e.g. FIGS. 3A and 3B). The elastic force may pull in a lengthwise direction. FIG. 23 includes arrows to illustrate lengthwise force of the elastic material of the baby sleep support to pull the baby towards the supporting person.

In accordance with embodiments described herein the baby sleep support 10 may be configured to generate an elastic force to pull the baby towards the supporting person to provide a snug and secure support. For example, the baby sleep support 10 (or a portion thereof) may be made of four way stretch fabric to provide different directions of elastic force to secure the baby to the supporting person. As another example, the baby sleep support (or a portion thereof) may be made of two way stretch fabrics.

Two way stretch fabrics stretch in two opposite directions or ways, such as crosswise, lengthwise, horizontally or vertically. The elastic stretches along the same line or plane in opposite directions. Four-way stretch fabrics stretch in four directions, such as crosswise and lengthwise, or horizontally and vertically. The line or plane of the stretch will depend on the direction of the elastic material weave, for example, or the grain. The four way stretch generally has stretch in four directions, along 2 intersecting lines or planes. The directions may be perpendicular, such as crosswise and lengthwise or horizontal and vertical, depending on the weave of the fabric. FIG. 28 illustrates arrows showing four-way stretch (e.g. crosswise, lengthwise, horizontally, vertically) with stretch in two perpendicular directions, or two non-perpendicular directions. The elastic material enables the sleep support 10 to adapt to the size of the baby and the supporting person to snugly create the perfect fit, while providing some elastic give for comfort.

A baby sleep support 10 (or a portion thereof) made from four way stretch fabric may generate elastic forces both crosswise and lengthwise to support the baby against the supporting person. A baby sleep support 10 made from two way stretch fabric may generate an elastic force in either the crosswise and lengthwise direction to support the baby to the supporting person. A baby sleep support 10 that is not made of stretch fabric may not generate an elastic force to secure the baby to the supporting person. The non-elastic material may not adapt to fit the baby as securely and snugly as the elastic material. The non-elastic material may be either too tight to cause discomfort or too loose to not provide a secure support.

Further, a baby sleep support 10 made of flexible four way stretch fabric may contour the baby and spread the elastic force crosswise and lengthwise to comfortably force the baby against the supporting person. That is, the plane of the elastic force may be the entire length and width of the baby sleep support 10. In contrast, a thin strip of non-elastic material strapped around a baby and the supporting person may generate a force concentrated in small portion of the baby's back which may result in discomfort. Further, the non-elastic material may not adapt to securely fit the baby. The non-elastic material may be either too tight to cause discomfort or too loose to not provide a secure support.

Accordingly, the baby sleep support 10 or a substantial portion (e.g. the elongated soft body 12) of the baby sleep support 10 may be made from elastic or stretch material to contour the baby to securely and snugly support the baby on the supporting person. The fabric of the baby sleep support 10 may also be wicking, breathable, and so on.

Using elastic or stretch material may configure the baby sleep support 10 with elastic properties including the tendency of the material to return to its original shape after being deformed, stretched, and so on, to generate an elastic force. The sleep support 10 may deform when external forces are applied on them, such as when the sleep support 10 is stretched around the baby and the supporting person and secured. If the material used for the sleep support 10 is elastic, then the elastic force of the sleep support 10 may try to return to its initial shape and size to securely and snugly support the baby on the supporting person. The sleep support 10 will try to return to its initial shape and size when external forces are removed (e.g. no longer wrapped around the baby and the supporting person and secured).

Referring back to FIGS. 1A and 2A, the baby sleep support 10 further includes a first fastening end 18 integrally connected to the first end 14 of the elongated soft body 12. The first fastening end 18 may have a first adjustable fastener mechanism 22. In use, the first fastening end 18 extends across the back torso of the baby. One side of the first fastening end 18 may be in contact with the back torso of the baby and the other side of the first fastening end 18 may expose the first adjustable fastener mechanism 22. The baby sleep support 10 further includes a second fastening end 20 integrally connected to the second end 16 of the elongated soft body 12. The second fastening end 20 may have a second adjustable fastener mechanism 24 configured to mate with the first adjustable fastener mechanism 22 of the first fastening end 18. In use, the second fastening end 20 overlaps the first fastening end 18 to secure the second fastening end 20 to the first fastening end 18 to support the baby on the front torso of the supporting person. The second adjustable fastener mechanism 24 may be on one side of the second fastening end such that it is in contact with the exposed first adjustable fastener mechanism 22 when overlapping. In accordance with some embodiments, the first and second fastening ends 18, 20 may be tapered to accommodate a smaller sized baby relative to the back torso of the supporting person which may prevent the smaller baby from being smothered by the sleep support 10 when secured.

The adjustable fastener mechanism 22 and the stretch fabric may configure the baby sleep support 10 to provide a snug, secure fit around the baby and the supporting person to accommodate different sized babies and people. That is, both elastic force and an adjustable fastening mechanism may work together to provide a secure and snug fit for the baby and the supporting person to accommodate different size babies and people and fluctuations in size.

Referring now to FIGS. 3A and 3B, there is shown perspective views of a baby sleep support 10 when the first and second fastening ends 18, 20 of the baby sleep support 10 are secured via the first and second fastener mechanisms 22, 24 according to some embodiments. As shown, the second fastening end 20 overlaps the first fastening end 18 to secure the baby to the torso of the supporting person. This is an illustrative example and other fastening mechanisms may be used to secure the baby sleep support 10.

Figure 4A:
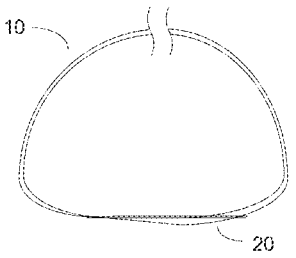
FIGS. 4A and 4B are top views of a baby support when the ends of the baby support are secured according to some embodiments.
Figure 5A:
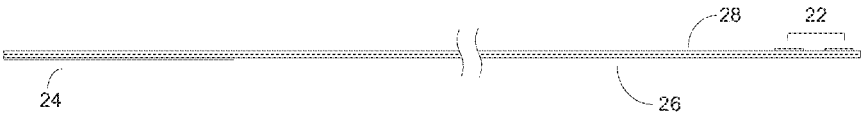
FIGS. 5A and 5B are top views of the baby support of FIGS. 1A and 1B.
Figure 6A:
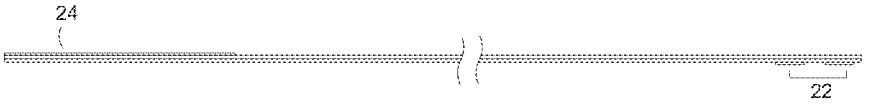
FIGS. 6A and 6B are bottom views of the baby support of FIGS. 1A and 1B.
Figure 4B:
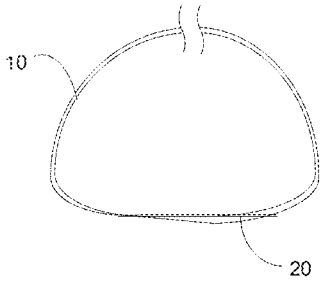
Figure 5B:
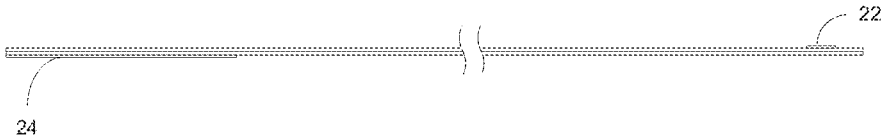
Figure 6B:
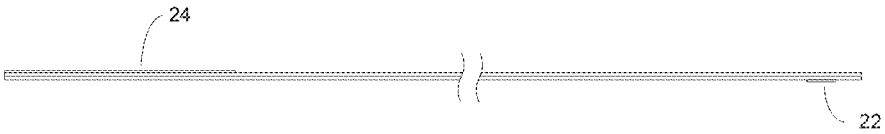
Figure 7B:
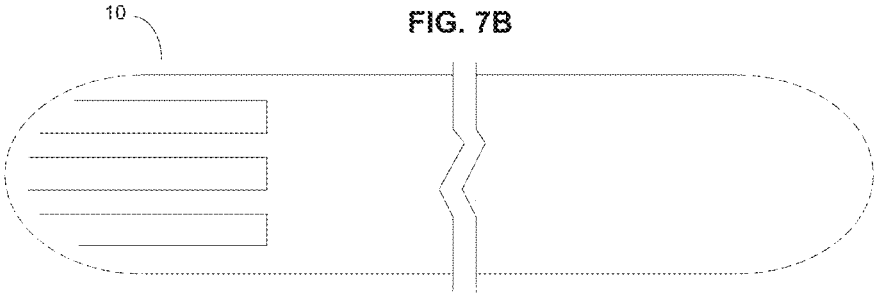

FIGS. 4A and 4B show top views of a baby sleep support 10 when the first and second fastening ends 18, 20 of the baby sleep support 10 are secured. FIG. 26 illustrates a top view of the baby sleep support 10 in progress of wrapping the first fastening end 18 around the back torso of the baby according to some embodiments. FIG. 25 illustrates a top view of the baby sleep support 10 when the second fastening end 20 overlaps the first fastening end 18 to secure the baby sleep support 10. The baby sleep support 10 may have a height proportional to the height of the torso of the supporting adult and to the height of the baby to distribute force across a larger surface area. For example, the baby sleep support 10 may be configured to distribute elastic force across a larger surface area (the height of the baby sleep support 10 or a substantial part thereof). The baby sleep support 10 may have a portion with a reduced height to accommodate a baby that is smaller than the torso of the supporting person, while still distributing force across the back torso of the adult and the baby.

Referring back to FIGS. 1A, 1B, 2A and 2B, the first and second adjustable fastener mechanisms 22, 24 may be made of fabric hook and loop fasteners, such as Velcro™, as a non-limiting illustrative example. Other fastener mechanisms may also be used. The second adjustable fastener mechanism 24 may be made of strips of fabric loop fasteners that are aligned parallel to a longitudinal axis of the baby sleep support 10. The first adjustable fastener mechanism 22 may be made of strips of fabric hook fasteners that are aligned perpendicular to the longitudinal axis of the baby sleep support 10.

Figure 1A:
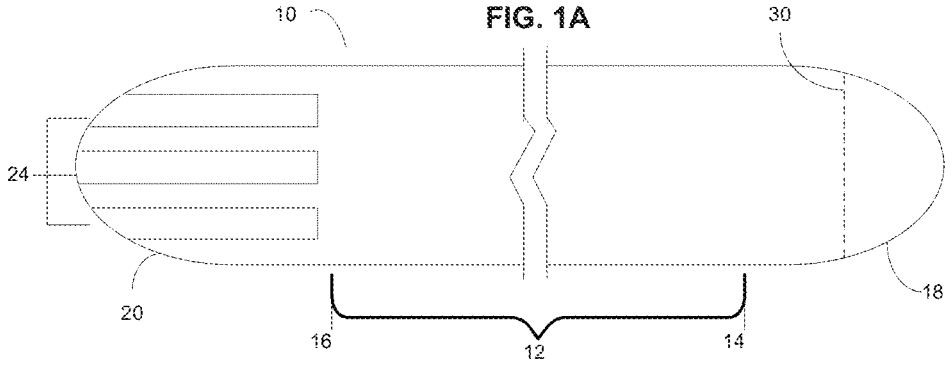
FIGS. 1A and 1B are front views of a baby support with strips of fabric hook and loop fastener according to some embodiments.
Figure 2A:
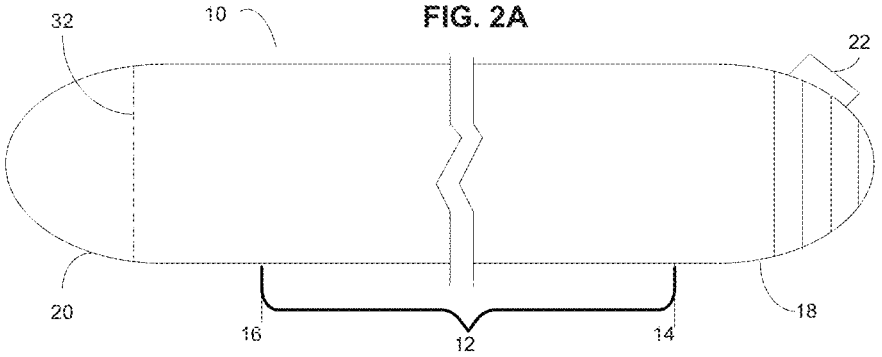
FIGS. 2A and 2B are rear views of a baby support with strips of fabric hook and loop fastener according to some embodiments.

In some embodiments, the second adjustable fastener mechanism 24 may be made of strips of fabric hook fasteners and the first adjustable fastener mechanism 22 may be made of strips of fabric loop fasteners, provided that the second adjustable fastener mechanism 24 mates with the first adjustable fastener mechanism 22. Other fabric fastening mechanisms or other fastening mechanisms may also be used to secure the first fastening end 18 to the second fastening end 20. In FIGS. 1A and 2A, although, the second adjustable fastener mechanism 24 is shown to include three strips of fabric fasteners and the first adjustable fastener mechanism 22 is shown to include two strips of fabric fasteners, more or less strips may be used. For example, in FIGS. 1B and 2B the first adjustable fastener mechanism 22 is shown to include one strip of fabric fastener. Further, the strips and orientation are non-limiting examples and other configurations, layouts and shapes may also be used such as oval, rounded rectangular, wavy strips, circular dots, solid panels, patches, circles, messenger style, diagonal lines, crisscross, and so on.

The first and second fastener mechanisms 22, 24 may be configured to distribute the force across the height of the baby sleep support 10, from a first edge to a second edge of the baby sleep support 10. The first fastening end 18 may have a portion of fabric to cushion the baby in the event that the second fastening end 20 has a scratchy fastening mechanism that may be exposed if the fabric does not cover it.

As an illustrative, non-limiting example, the elongated soft body 10 may have a rectangular shape, the first fastening end 18 may have a semi elliptical shape, and the second fastening end 20 may have a semi elliptical shape. The first end 14 of the elongated soft body 12 may be proportionally sized in height and integrally connected to a major axis 30 of the first fastening end 18. The second end 16 of the elongated soft body 10 may be proportionally sized in height and integrally connected to a major axis 32 of the second fastening end 20. This is an example only and the elongated soft body 10, the first fastening end 18, and the second fastening end 20 may have a variety of shape configurations (see e.g. FIG. 27).

Figure 1B:
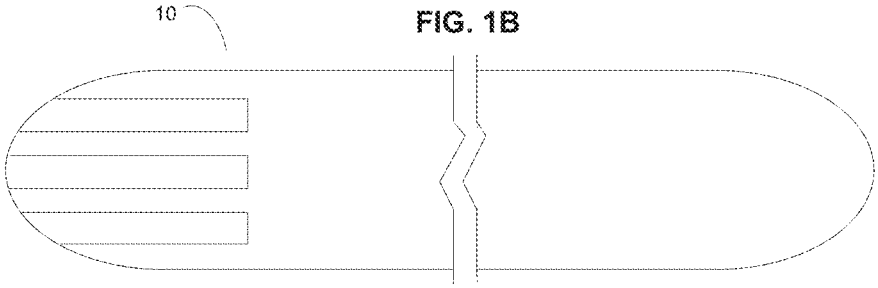
Figure 2B:
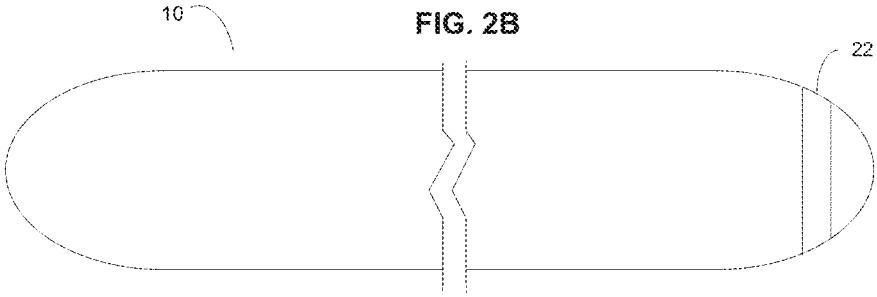

Referring now to FIGS. 5A, 5B, 6A and 6B, there is shown a top and bottom view of the baby sleep support 10 of FIGS. 1A and 1B, including the first and second adjustable fastener mechanisms 22, 24. In accordance with some embodiments, the baby sleep support 10 may be made from two pieces of stretch fabric 26, 28 sewn together at the perimeters. The elongated soft body 12 may have a front and back side, the first fastening end 18 may have a front and back side, and the second fastening end 20 may have a front and back side. The front sides of the elongated soft body 12, the first fastening end 18, and the second fastening end 20 may have the same orientation (i.e. facing the same way), and the back sides of the elongated soft body 12, the first fastening end 18, and the second fastening end 20 may also have the same orientation (i.e. facing the same way). The first piece of stretch fabric 26 may provide the front sides and the second piece of stretch fabric 28 may provide the back sides. This is an example of the elongated soft body 12, the first fastening end 18, and the second fastening end 20 being integrally connected. In other embodiments, the pieces may be sewn together in different configurations. In this example, the front side of the second fastening end 20 may have the second fastener mechanism 24 and the back side of the first fastening end 18 may have the first fastener mechanism 22. When the baby sleep support 10 wraps around the torso of the supporting person and the baby the first and second fastener mechanisms 22, 24 face each other and overlap to mate and secure the baby sleep support 10.

The shape of the baby sleep support 10 shown in FIGS. 1A, 1B, 2A, and 2A is an example and the baby sleep support 10 may have other shape configurations. Referring now to FIGS. 7A, 7B, 8A and 8B, there is shown front and rear views of a baby sleep support 10 according to some embodiments. The stippled lines illustrate that the first and second fastening ends 18, 20 of the baby sleep support 10 may have a different shape (other than the example semi-elliptical shape shown). For example, FIGS. 19A, 19B, 20A and 20B illustrate a front and rear view of a baby sleep support 10 according to some embodiments where the first and second fastening ends 18, 20 have a rounded square or rectangular shape. FIG. 27 illustrates other example shape configurations for a baby sleep support 10 according to some embodiments.

In accordance with embodiments described herein, the second adjustable fastener mechanism 24 is configured to mate with the first fastener mechanism 22 in a plurality of positions. Each position may provide a different perimeter for the baby sleep support 10 when the second fastening end 20 overlaps the first fastening end 18 to secure the second fastening end 20 to the first fastening end 18. This may enable the baby sleep support 10 to adapt to different size people and babies. FIGS. 3A and 3B illustrate an example elliptical perimeter of the baby sleep support 10 when its first and second fastening ends 18, 20 are secured. In the example embodiment shown in FIGS. 1A, 1B, 2A and 2B, the second adjustable fastener mechanism 24 may be made of strips of fabric loop fasteners that are aligned parallel to a longitudinal axis of the baby sleep support 10 and the first adjustable fastener mechanism 22 may be made of strip(s) of fabric hook fasteners aligned perpendicular to the longitudinal axis of the baby sleep support 10. Accordingly, the second adjustable fastener mechanism 24 provides different longitudinal positions that the first fastener mechanism 22 can attach to. This enables the second adjustable fastener mechanism 24 to secure to the first adjustable fastener mechanism 22 in a number of different places in order to accommodate different size people and babies, as well as ensure a snug fit for the secured baby sleep support 10. The variety of attachment positions coupled with stretch fabric may provide a snug fit adapted to the size of the baby and person. Each position will result in a different perimeter size of the baby sleep support 10 when secured. Accordingly, as the baby and the supporting person change size the baby sleep support 10 can adjust accordingly by changing perimeter size when secured depending on what position along the strips the second adjustable fastener mechanism 24 is attached to the first adjustable fastener mechanism 22. The second adjustable fastener mechanism 24 may have strips configured parallel to the longitudinal axis of the baby sleep support 10 to provide a variety of different possible positions to change the perimeter of the baby sleep support 10 when secured. For example, if the second adjustable fastener mechanism 24 is secured to the first adjustable fastener mechanism 22 at a position closer to where the second fastening end 20 meets the elongated soft body 12 then the perimeter of the baby sleep support 10 may be smaller than if the second adjustable fastener mechanism 24 is secured to the first adjustable fastener mechanism 22 at a position closer to the other end of the second fastening end 20 (e.g. the semi-elliptical shaped end in this example). The multi-strip implementation may also provide a secure fit as it provides multiple places for attachment.

The first and second adjustable fastener mechanisms 22, 24 may be implemented using a variety of shapes of fabric hook and loop fastener to secure the baby sleep support 10. FIGS. 9A, 9B, 10A and 10B illustrate front and rear views of a baby sleep support 10 according to some embodiments. The stippled lines illustrate that the fabric hook and loop fastener of the first and second adjustable fastener mechanisms 22, 24 may have a variety of shapes and may not be limited in strips. There may also be different numbers of strips, widths of strips, and lengths of strips.

FIGS. 11A, 11B, 12A and 12B illustrate front and rear views of a baby sleep support 10 according to some embodiments. The first and second adjustable fastener mechanisms 22, 24 may be implemented using semi-elliptical shaped sections of fabric hook and loop fastener to correspond to the shape of the first and second fastening ends 18, 20. Other shapes may also be used for both the first and second adjustable fastener mechanisms 22, 24 and first and second fastening ends 18, 20.

The first and second adjustable fastener mechanisms 22, 24 may be implemented using a variety of fastening devices to secure the baby sleep support 10. The stippled lines shown in FIGS. 9A, 9B, 10A and 10B illustrate that different types of fastening devices may be used for the first and second adjustable fastener mechanisms 22, 24. For example, buttons and button holes may be used to implement the first and second adjustable fastener mechanisms 22, 24. FIGS. 13A and 13B are front views of a baby sleep support 10 with columns of button holes for the second adjustable fastener mechanism 24 according to some embodiments. FIGS. 14A and 14B are rear views of a baby sleep support 10 with a column of buttons for the first adjustable fastener mechanism 22 according to some embodiments. Buttons may be used for the second adjustable fastener mechanism 24 and button holes may be used for the for the first adjustable fastener mechanism 22 in other embodiments. Further, different configurations and layouts of buttons and button holes may also be used and columns are an example only.

As another example, hooks and eyes may be used to implement the first and second adjustable fastener mechanisms 22, 24. FIGS. 15A and 15B are front views of a baby sleep support 10 with columns of eyes for the second adjustable fastener mechanism 24 according to some embodiments. FIGS. 16A and 16B are rear views of a baby sleep support 10 with a column of hooks for the first adjustable fastener mechanism 22 according to some embodiments. Hooks may be used for the second adjustable fastener mechanism 24 and eyes may be used for the first adjustable fastener mechanism 22 in other embodiments. Further, different configurations, shapes and layouts of hooks and eyes may also be used and the illustrated shapes/types and column layout are examples only.

As a further example, snaps may be used to implement the first and second adjustable fastener mechanisms 22, 24. FIGS. 17A and 17B are front views of a baby sleep support 10 with columns of half snaps (i.e. half of side of a snap) for the second adjustable fastener mechanism 24 according to some embodiments. FIGS. 18A and 18B are rear views of a baby sleep support 10 with a column of half snaps (i.e. the other half snap) for the first adjustable fastener mechanism 22 according to some embodiments. Different configurations, shapes and layouts of snaps may also be used and the illustrated shapes/types and column layout are examples only.

As another example, elastic loops and tabs may be used to implement the first and second adjustable fastener mechanisms 22, 24. FIGS. 21A and 21B are front views of a baby sleep support 10 with columns of tabs for the second adjustable fastener mechanism 24 according to some embodiments. FIGS. 22A and 22B are rear views of a baby sleep support 10 with a column of elastic loops for the first adjustable fastener mechanism 22 according to some embodiments. Elastic loops may be used for the second adjustable fastener mechanism 24 and tabs may be used for the for the first adjustable fastener mechanism 22 in other embodiments. Further, different configurations, shapes and layouts of elastic loops and tabs may also be used and the illustrated shapes/types and column layout are examples only. Other example fasteners include ties, buckles, toggle straps, clips, and so on.

In accordance with some embodiments, the elongated soft body 12 of the baby sleep support 10 may include a cushion on a portion that goes against back torso of adult to cushion the adult while sitting in a chair. The cushion may be an orthopedic cushion to support for the torso of the supporting person. Further, the baby sleep support 10 may also include arm rests, pockets, heating pads, different linings (e.g. fleece), electronic charging modules, and other features and configurations. Other example features for the baby sleep support 10 include a weather (e.g. sun, rain, wind) shield or hood for outdoor use, a foot cozy for baby, hand muff for supporting person, pacifier clip or an attached pacifier, a bottle sleeve, and digital music file (e.g. MP3) reader slot, adaptor or sound connector system.

The baby sleep support 10 may be made of stretch fabric, such as two-way or four-way stretch fabric. Using stretch fabric enables the sleep support to stretch to secure the baby to the torso of the supporting person in a comfortable and secure manner. Light weight stretch fabric may be breathable and comfortable in a variety of climates and temperatures. The stretch fabric may be washable for ease of care. The secure and snug manner of the stretch fabric may hug and cradle the baby to provide additional comfort. The supportive stretch fabric may also provide an abdominal binder which may be recommended postpartum to tighten uterus or abdominals of the supporting person.

The baby sleep support 10 may enable direct contact between the baby and the supporting person by not having a layer of fabric between the baby and the supporting person. This direct contact may facilitate skin to skin bonding and breast feeding. The supporting person may be topless or wear an open shirt to expose skin. The supporting person may lay the baby directly on their chest and lean back slightly. The baby sleep support 10 may be positioned around the back torso of the supporting person and wrapped around the baby and secured in the desired position. The skin of the baby may then be in contact with the skin of the supporting person without a layer of fabric or other material between the supporting person and the baby.

Further, the first and second adjustable fastener mechanisms 22, 24 may facilitate easy removal of the baby sleep support 10 from the supporting person which may be beneficial to transfer the sleeping baby to a crib or other sleep system for the baby. Further, as the baby sleep support 10 may be positioned around the torso of a supporting person and under the arms of the supporting person this enables the supporting person to be hands-free. This may facilitate easy removal of the baby sleep support 10 as the person can reach behind the back of the baby to undue the first and second fastening ends 18, 20. The person can also easily adjust the size of the perimeter of the secured baby sleep support 10 by reaching behind the back of the baby and undue the first and second fastening ends 18, 20 and change position of the adjustable first and second fastener mechanisms 22, 24. The secure fit of the baby sleep support 10 also enables the support person to rock the baby to sleep by moving their torso.

In accordance with some embodiments, such as the example shown in FIGS. 1A to 6B, the baby sleep support may be constructed using large pieces of fabric sewn together at the perimeter which may be cost effective for manufacturing, as a large number of parts with a complex design may result in higher manufacturing costs. Further, using strips of fabric hook and loop fastener may provide a comfortable and flexible implementation for the first and second fastener mechanisms. These strips may be sewn onto the large pieces of fabric that make up the elongated soft body 12 and first and second fastening ends 18, 20, which also may be cost effective for manufacturing as the same technique (e.g. sewing) may be used construct the entire baby sleep support 10. The baby sleep support 10 may be made of different types of fabric to accommodate different temperatures and personal interests.

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing implementation of the various embodiments described herein.

The invention claimed is:

1. A method for supporting a baby positioned on a front torso of a supporting person in skin-to-skin contact using a baby support, the method comprising:

extending an elongated soft body with a first and a second end across a back torso of the supporting person, the first end extending under an arm and across a side torso of the supporting person, and the second end extending under the other arm and across the other side torso of the supporting person;

extending a first fastening end across a back torso of the baby, the first fastening end integrally connected to the first end of the elongated soft body, the first fastening end having a first fastener mechanism;

securing the baby support with a second fastening end having a second fastener mechanism such that the second fastening end overlaps the first fastening end to affix the second fastener mechanism to the first fastener mechanism to support the baby on the front torso of the supporting adult, the second fastening end integrally connected to the second end of the elongated soft body, the second fastener mechanism configured to mate with the first fastener mechanism of the first fastening end; and stretching the baby support to generate an elastic force to pull the back torso of the baby towards the back torso of the supporting person to maintain the skin-to-skin contact between the baby and the supporting person, the entire length and width of the baby support, including both the elongated soft body and the first and second fastening ends, being made of stretch fabric configured to contour the baby to provide a secure and snug support through stretch in four directions to generate an elastic force to pull the back torso of the baby towards the back torso of the supporting person such that a plane of the elastic force extends to the entire length and width of the baby support.

2. The method of claim 1, wherein the elongated soft body has a rectangular shape, wherein the first fastening end has a semi elliptical shape, and wherein the second fastening end has a semi elliptical shape, wherein the first end of the elongated soft body is proportionally sized and integrally connected to a major axis of the first fastening end and the second end of the elongated soft body is proportionally sized and integrally connected to a major axis of the second fastening end.

3. The method of claim 1, wherein the second fastener mechanisms is configured to adjustably mate with the first fastener mechanism in a plurality of positions such that each position provides a different perimeter for the baby support when the second fastening end overlaps the first fastening end to secure the baby support.

4. The method of claim 1, wherein the first and second fastening ends are tapered.

5. The method of claim 4, wherein the second fastener mechanism comprises one or more strips of fabric loop fasteners parallel to a longitudinal axis of the baby support and the first fastener mechanism comprises one or more strips of fabric hook fasteners perpendicular to the longitudinal axis of the baby support.

6. The method of claim 4, wherein the second fastener mechanism comprises one or more strips of fabric hook fasteners parallel to a longitudinal axis of the baby support and the first fastener mechanism comprises one or more strips of fabric loop fasteners perpendicular to the longitudinal axis of the baby support.

7. The method of claim 1, wherein the stretch fabric comprises two layers of four way stretch fabric.

8. The method of claim 1, wherein the baby support comprises a first and second pieces of stretch fabric sewn together at the perimeters, wherein the elongated soft body has a front and back side, wherein the first fastening end has a front and back side, and wherein the second fastening end has a front and back side, wherein the first piece of stretch fabric provides the front sides and the second piece of stretch fabric provides the back sides.

9. The method of claim 1, wherein the baby support has a front side and a rear side, wherein the second fastener mechanism is on the front side and the first adjustable fastener mechanism is on the rear side.

10. The method of claim 1, wherein the elongated soft body comprises a cushion, the method further comprising supporting the back torso of the supporting person with the cushion.

11. The method of claim 1, wherein the first and second adjustable fastener mechanisms are selected from the group consisting of: hook and loop, buttons and button holes, snaps, hooks and eyes, ties, toggles, buckles, elastic loops and tabs.

12. A method for supporting a baby positioned on a front torso of a supporting person in skin-to-skin contact, the method comprising:

extending an elongated soft body around a portion of a back torso of the supporting person and around a portion of a back torso of the baby;

securing the baby on a front torso of the supporting adult by fastening an adjustable fastening mechanism integrally connected to the elongated soft body, wherein the adjustable fastening mechanism is configured to adjustably fasten in a plurality of positions such that each position provides a different perimeter for the baby support when secured; and stretching the baby support to generate an elastic force to pull the back torso of the baby towards the back torso of the supporting person to maintain the skin-to-skin contact between the baby and the supporting person, to maintain the skin-to-skin contact between the baby and the supporting person, the entire length and width of the baby support, including both the elongated soft body and the first and second fastening ends, being made of stretch fabric configured to contour the baby to provide a secure and snug support through stretch in four directions to generate an elastic force to pull the back torso of the baby towards the back torso of the supporting person such that a plane of the elastic force extends to the entire length and width of the baby support.

13. The method of claim 12, wherein an entire height of at least a portion of the elongated soft body is configured to stretch in a lengthwise direction to distribute the elastic force along the entire height of the at least a portion of the elongated soft body.

14. The method of claim 12, wherein the elongated soft body is configured to stretch in four directions.

15. The method of claim 12, wherein the elongated soft body is configured to stretch in a lengthwise direction to pull the back torso of the baby towards the back torso of the supporting person.

16. The method of claim 12, wherein the elongated soft body is configured to stretch in a lengthwise and a crosswise direction.

17. The method of claim 12, wherein in use the baby support positions the baby on the front torso of the supporting person such that the skin of the baby is in direct contact with the skin of the supporting person.

18. The method of claim 12, wherein the adjustable fastening mechanism comprises a first fastener affixed to a first end of the elongated soft body and a second fastener affixed to a second end of the elongated soft body, wherein the a first fastener adjustably mates with the second fastener.

19. A method for supporting a baby positioned on a front torso of a supporting person in skin-to-skin contact, the method comprising:

extending a baby support across a back torso of the supporting person, under each arm of the supporting person, across each side torso of the supporting person, and across a back torso of the baby, wherein the baby support comprises an elongated soft body with a first and a second end, a first fastening end integrally connected to the first end of the elongated soft body, the first fastening end having a first fastener adjustable mechanism, and a second fastening end integrally connected to the second end of the elongated soft body, the second fastening end having a second adjustable fastener mechanism configured to adjustably mate with the first adjustable fastener mechanism of the first fastening end;

overlapping the baby support to affix the second fastener mechanism to the first fastener mechanism to support the baby on the front torso of the supporting adult; and stretching the baby support to generate an elastic force to pull the back torso of the baby towards the back torso of the supporting person to maintain the skin-to-skin contact between the baby and the supporting person, to maintain the skin-to-skin contact between the baby and the supporting person, the entire length and width of the baby support, including both the elongated soft body and the first and second fastening ends, being made of stretch fabric configured to contour the baby to provide a secure and snug support through stretch in four directions to generate an elastic force to pull the back torso of the baby towards the back torso of the supporting person such that a plane of the elastic force extends to the entire length and width of the baby support.

* * * * *